US006147336A

United States Patent [19]

Ushijima et al.

[11] Patent Number: 6,147,336

[45] Date of Patent: Nov. 14, 2000

[54] INDUCTION HEATERS FOR HEATING FOOD, FLUIDS OR THE LIKE

[75] Inventors: Kazufumi Ushijima; Takeshi Fujita; Toshiyuki Hirata, all of Moriguchi, Japan

[73] Assignee: Japanese Research and Development Association for Application of Electronic Technology in Food Industry, Tokyo, Japan

[21] Appl. No.: 09/253,940

[22] Filed: Feb. 22, 1999

[30] Foreign Application Priority Data

Feb. 26, 1998 [JP] Japan ..... 10-064308
Jul. 28, 1998 [JP] Japan ..... 10-212246

[51] Int. Cl.[7] ..... H05B 6/12; H05B 6/40; H05B 6/76; H05B 6/78

[52] U.S. Cl. ..... 219/601; 219/622; 219/624; 219/670; 219/675; 219/680; 219/629; 219/699; 219/738; 99/DIG. 14; 99/451

[58] Field of Search ..... 219/601, 620, 219/622, 624, 634, 653, 656, 670, 675, 676, 680, 738, 699, 700, 701, 628, 629, 630; 99/DIG. 14, 451

[56] References Cited

U.S. PATENT DOCUMENTS

| | | | |
|---|---|---|---|
| 2,406,640 | 8/1946 | Siecke | 219/628 |
| 4,112,285 | 9/1978 | Pan et al. | 219/653 |
| 4,471,191 | 9/1984 | Greis et al. | 219/629 |
| 4,503,305 | 3/1985 | Virgin et al. | 219/628 |
| 4,987,828 | 1/1991 | Nuns et al. | 219/675 |

FOREIGN PATENT DOCUMENTS

| | | | |
|---|---|---|---|
| B2-59-22132 | 5/1984 | Japan . | |
| 63-281377 | 11/1988 | Japan | 219/601 |
| 1-107016 | 4/1989 | Japan | 219/680 |
| 2-183993 | 7/1990 | Japan | 219/601 |
| 3-196611 | 8/1991 | Japan | 219/680 |
| 8-49854 | 2/1996 | Japan . | |
| 9-4849 | 1/1997 | Japan . | |
| 10-255963 | 9/1998 | Japan . | |

*Primary Examiner*—Philip H. Leung
*Attorney, Agent, or Firm*—Oliff & Berridge, PLC

[57] ABSTRACT

A cooking apparatus includes a fan 13 provided at the top wall of a heating chamber 2 with its front face directed downwards. A spiral coil 14 in the form of a flat disc is provided around a rotation shaft 12 above the heating chamber 2. When high-frequency current is supplied to the coil 14, the coil 14 generates an alternating magnetic flux. The magnetic flux penetrates a shielding plate 16 and the fan 13, whereby the fan 13 is inductively heated. The fan 13 draws air from the heating chamber 2 and propels the air back to the heating chamber 2, where the air is heated when it contacts the fan 13. As a result, the temperature in the heating chamber rises, so that an object placed on a turntable 5 is cooked. By such a constitution, it is not necessary to keep additional space open for a heating element because the fan 13 functions as a heating element. Accordingly, it is possible to enlarge the diameter of the fan 13 so that the blowing efficiency is enhanced. Also, by this constitution, the number of parts is reduced and the structure is simplified.

15 Claims, 8 Drawing Sheets

Fig. 5
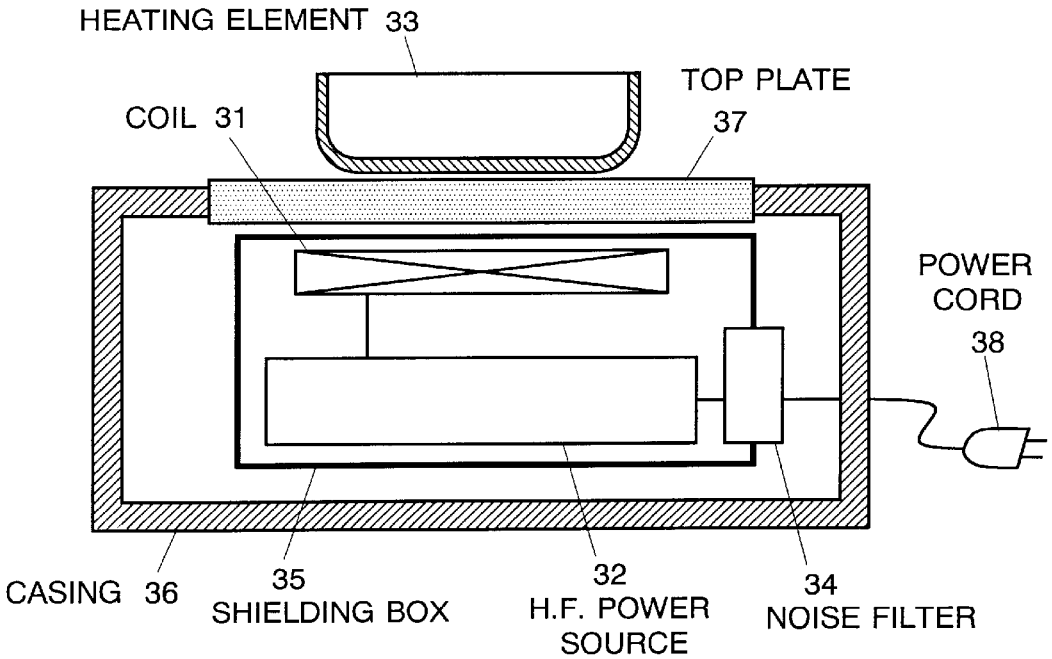
Fig. 6
(%)
| FREQUENCY / THICKNESS | 25 kHz | 150 kHz | 150 MHz |
|---|---|---|---|
| NONE (0 mm) | 100 | 100 | 100 |
| 0.02 mm | 96 | 93 | $3.1 \times 10^{-2}$ |
| 0.10 mm | 82 | 72 | $8.9 \times 10^{-4}$ |
| 0.20 mm | 69 | 58 | $2.5 \times 10^{-4}$ |
Fig. 7
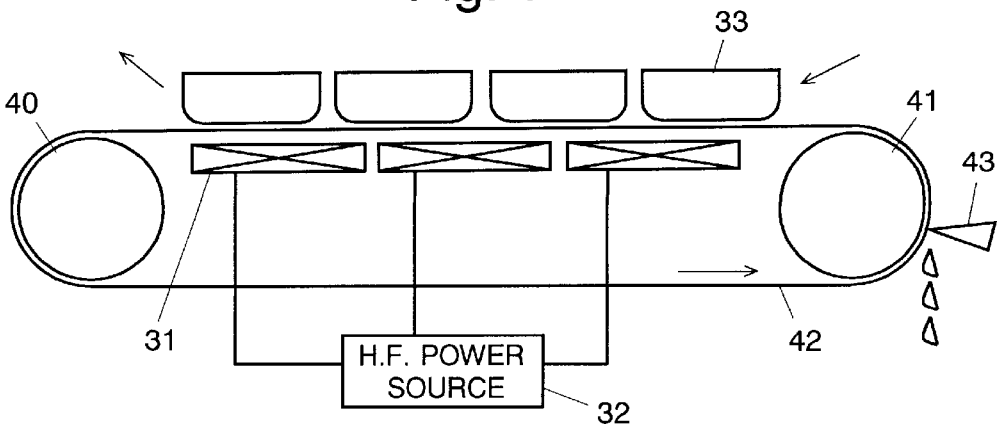

INDUCTION HEATERS FOR HEATING FOOD, FLUIDS OR THE LIKE

The present invention relates to an induction heater, particularly to that applicable to a cooking apparatus for heating foods or other products to be heated.

BACKGROUND OF THE INVENTION

Various types of cooking apparatuses having a heating chamber for containing and heating food are manufactured currently. For example, one of those types of apparatuses includes a magnetron or similar device for generating microwaves to cook food through the dielectric heating method using those microwaves, and another type uses hot air for cooking food. Also, in some of the apparatuses, food is cooked by a combination of these two methods. Further, some apparatuses are known for supplying steam in the heating chamber while heating food with one of the above-described methods. Such types of apparatuses are disclosed in Japanese Examined Patent Publication No. S59-22132, Japanese Unexamined Patent Publication No. H8-49854, and Japanese Unexamined Patent Publication No. H9-4849, for example.

FIG. 11 shows the structure of a steam oven, a conventional cooking apparatus utilizing hot air. The steam oven has a heating chamber 91 provided with a tray 92 inside for mounting an object to be heated. A pot-like enclosure 93 is attached to the back wall of the heating chamber 91, and a fan motor 94 is disposed behind the enclosure 93. The rotation shaft 95 of the fan motor 94 penetrates the wall of the enclosure 93, and a fan 96 is fixed to the end of the rotation shaft 95. A sheathed heater 97 connected to a power circuit (not shown) is provided to surround the fan 96 concentrically.

During a heating process, the fan 96 is rotated for drawing air from the center of the front face and propelling the air toward the circumference. Meanwhile, electric power is supplied to the heater 97, and the propelled air is heated when it contacts the heater 97. The hot air is sent back to the heating chamber 91.

Also, the heating chamber 91 is equipped with a vaporizer 98 having a heater 981 and a tank 982. During the heating process, electric power is supplied also to the heater 981 for vaporizing water in the tank 982 to steam. The steam is supplied into the heating chamber 91 not only for preventing food from being dried by the hot air, but also for improving the heating efficiency. That is, when the heating is carried out with the steam (superheated steam, preferably) being supplied, the steam gives a substantial amount of heat to the food when it contacts the food, so that the time required for cooking becomes shorter than that required in the case where no steam is supplied.

In the above-described steam oven, however, the heat exchanging effectiveness is not high, because the heater 97 is covered with a heat-resistant insulating material and it is structurally difficult to enlarge the surface area of the heater 97. Therefore, if an excessive amount of power is supplied to the heater 97, the temperature of the inside of the heater 97 temporarily becomes abnormally high, which may cause a fault or other damage. Accordingly, the maximum power supply to the heater 97 is limited, which prevents the food from being heated rapidly.

For addressing the above-described problems, the applicant proposed a novel cooking apparatus disclosed in Japanese Unexamined Patent Publication No. H10-255963. The apparatus has a heating chamber for containing an object to be heated, and a cylindrical cup-shaped enclosure made of an insulating material attached to the back wall of the heating chamber. In the enclosure, a fan is provided for drawing air from the center and propelling the air toward the circumference, and a cylindrical heating element is disposed to surround the fan concentrically. A coil is wound around the outside of the cylindrical side wall of the enclosure. The coil is connected to a power supply unit for supplying high-frequency electric power to the coil so that the heating element is inductively heated. In this apparatus, when a high-frequency current is supplied from the power supply unit to the coil, a magnetic flux is generated by the coil. The magnetic flux passes through the cylindrical heating element, whereby an electric current is induced in the heating element circumferentially. Here, the heating element is heated by the Joule heat generated by the induced electric current. Thus, the air propelled toward the heating element is heated.

In this cooking apparatus, a large amount of electric power can be supplied to the coil because the coil itself does not generate heat. Also, the heating efficiency is very high, because the coil and the heating element are disposed adequately close to each other with the cylindrical wall of the enclosure inbetween. Thus, by raising the temperature rapidly, the user can heat food in an adequately short time without damaging its taste or flavor.

In such a cooking apparatus utilizing induction heating, it is preferable to increase the number of loops of the coil to improve the heating efficiency. The number of loops of the coil can be increased by making the cylindrical enclosure longer, but this makes the induction heating unit (consisting mainly of the enclosure, the fan, the heating element and the coil) larger. Taking this problem into account, the applicant further filed Japanese Patent Application No. H9-285996, proposing a cooking apparatus having a shortened induction heating unit. In this apparatus, a heating element in the form of a flat ring is disposed to surround the fan concentrically, and a spiral coil in the form of a flat disc centering on the rotation shaft of the fan is disposed behind the heating element. By such a construction, the number of loops of the coil can be increased without making the induction heating unit larger (or thicker).

In the above-described apparatus, however, it is impossible to increase the diameter of the fan, because it is necessary to keep an adequate space open for the heating element around the fan. Therefore, a strong air flow (or strong wind pressure) cannot be generated when the speed of the fan is low.

For addressing the above-described problems, the present invention proposes a first induction heater applicable to an induction heating unit of a cooking apparatus, which is constructed so that the diameter of the fan can be increased without making the induction heating unit thick or large.

Currently, the most widely used cooking apparatus utilizing induction heating is a domestic induction heater having a top plate and an induction coil placed under the top plate. A pan or pot with food therein is placed on the top plate and is inductively heated. With such an induction heater, it is necessary that the top plate itself does not perform as a load for induction heating, and that the top plate has an adequate heat-resistance. For example, a plate made of insulating material such as ceramic is used as the top plate.

In such an induction heater, an electric current having a high-frequency of about 10 kHz to several tens of kHz, is supplied from a power supply unit to the coil. Here, the current generated by the power supply unit includes also higher harmonic components, and electromagnetic waves including the higher harmonic components are radiated to the outside from the coil, which functions as an antenna.

Most conventional electric or electronic apparatuses are designed to have a shielding means for suppressing leakage of electromagnetic waves to the outside. In the induction heater, however, it is difficult to block the undesired electromagnetic waves effectively because the source of the electromagnetic waves to be shielded is the generator of the magnetic field required for induction heating, which must not be shielded electromagnetically. For addressing this problem, the present invention proposes a second induction heater constructed so that the leakage of high-frequency electromagnetic waves is prevented effectively without decreasing the heating efficiency.

SUMMARY OF THE INVENTION

Accordingly, the present invention proposes a first induction heater having a substantially closed heating chamber for containing an object to be heated, which further includes:

- a metallic fan, provided at an inner wall of the heating chamber, for drawing air from the center thereof and for propelling the air toward the circumference thereof;
- a coil provided behind the fan; and
- a power supply unit for supplying a high-frequency electric power to the coil so that the fan is inductively heated.

In the first induction heater, when high-frequency electric power is supplied from the power supply unit to the coil, the coil generates an alternating magnetic flux penetrating the metallic fan. The magnetic flux induces eddy current in the fan, whereby the fan is inductively heated. In the heating chamber, the fan draws air from the center of its front face and propels the air toward the circumference, where the air contacts the fan and is heated as a result of heat exchange. Thus, a circulating flow of hot air is generated in the heating chamber, the temperature in the heating chamber rises, and the cooking of the object proceeds in the heating chamber. The surface of the object being heated is roasted to a brown color by the hot air circulating in the heating chamber. Moreover, the object is also heated by the radiant heat emitted from the heated fan.

In the first induction heater, it is not necessary to keep additional space open for a heating element, because the fan itself is utilized as a heating element for induction heating. Accordingly, it is possible to increase the diameter of the fan so that the blowing efficiency is enhanced. Further, since the fan is utilized as the heating element, the number of parts of the induction heater is reduced and the structure of the induction heater is simplified, so that the production cost is reduced.

In the first induction heater, the coil may be preferably a spiral coil in the form of a flat disc centering on the rotation shaft of the fan. By such a construction, it is possible to design a thin induction heating unit, because the coil is substantially parallel to the fan. Thus saving space, the size of the outer case of the cooking apparatus can be smaller without changing the capacity of the heating chamber. In other words, the capacity of the heating chamber can be increased without enlarging the outer case.

The first induction heater may further include: a microwave heating unit including a magnetron for heating the object by microwave radiation; and a shielding wall disposed between the coil and the fan for shielding against the microwaves generated by the magnetron and for allowing the magnetic flux from the coil to pass therethrough. From such a construction, the cooking of the object is completed in an adequately short time without damaging the taste and flavor of the object when the temperature of the object is directly raised by the microwave heating process, in addition to the indirect heating with hot air and/or radiant heat from the fan. Since the shielding wall prevents the microwaves from reaching the coil, the leaking of microwaves from the heating chamber via the coil is avoided.

The shielding wall may be preferably a metallic plate having a number of holes at a preset hole to plate area ratio, or a thin metallic plate having no holes. As to the former plate, the hole to plate area ratio is determined so that an adequate amount of magnetic flux from the coil can pass through the holes while maintaining an adequate microwave shielding effect. As to the latter plate, on the other hand, the thickness of the metallic plate is determined so that an adequate amount of magnetic flux from the coil can pass through the plate while the plate itself does not perform as an excessive load for induction heating. As a result, the microwaves can be blocked effectively without decreasing the induction-heating efficiency of the fan. It should be noted that both of the shielding walls are easy to manufacture and causes no substantial increase in cost.

The first induction heater may further include a fan guard including: a cylindrical wall part concentrically surrounding the fan at a preset distance from the outer-most end of the fan; and a plate part disposed in front of the fan and having an air-drawing opening and an air-blowing opening. Such a structure prevents the user from touching the fan when the heating chamber is opened, as the fan is not exposed to the inside of the heating chamber. The flow of air propelled by the fan is directed to the heating chamber by the cylindrical wall, whereby the flow of hot air is supplied evenly into the heating chamber.

In the first induction heater, the fan may be preferably provided at the top wall of the heating chamber with its front face directed downwards. With such a construction, the diameter of the fan can be larger than when the fan is disposed at a side wall or at the back wall, because the top wall is generally larger than the side walls or the back wall. This construction, consequently, not only improves the blowing efficiency but also the heating efficiency by increasing the number of loops of the coil due to the increase in the diameter of the fan. In addition, when the hot air contacts the object being heated from above, the surface of the object is heated evenly, such that cooking proceeds without damaging the appearance and taste of the object.

The above-described induction heater may further include a water supply unit for supplying water onto the back of the fan. In this induction heater, when water is supplied onto the back of the fan, the water is dispersed into tiny drops, which are vaporized to steam when they contact the fan or hot air around the fan. The steam is carried into the heating chamber by the flow of hot air and contacts the object being cooked. There, the latent heat of the steam is transferred to the surface of the object, whereby the heating efficiency is improved. In addition, by supplying the steam, the drying of the surface of the object is prevented, such that the cooking proceeds without damaging the taste of the object.

Also, the present invention proposes a second induction heater including:

- a coil;
- a power supply unit for supplying high-frequency electric power to the coil;
- a heating element inductively heated by the coil; and
- a shield made of a metal and disposed between the heating element and the coil, and constructed so that a substantial amount of magnetic flux generated by the coil is allowed to pass therethrough.

In the second induction heater, the shield may be, for example, a thin metallic plate of about 0.1 mm in thickness and having no holes, or a metallic plate having a number of holes formed with an appropriate hole to plate area ratio.

As for the second induction heater, when the power supply unit supplies electric power to the coil, the coil generates an alternating magnetic flux, whereby eddy currents are induced in the heating element and the heating element generates heat. With this induction heater, a pot or pan, used to hold the object to be heated, may be used as the heating element. This method is preferable in that the object is heated directly. It is also possible that the object could be heated indirectly via the air or a liquid (e.g. water or oil) between the heating element and the object. The shield is constructed so that electromagnetic waves pass through itself at and around the frequency of the electric power supplied to the coil, while electromagnetic waves of higher orders are substantially blocked thereby. By such a construction, the leakage of undesired electromagnetic waves is prevented effectively without decreasing the efficiency of induction heating.

In a preferable mode of the second induction heater, the shield encloses the coil and the power supply unit, except for a power cord for supplying electric current. By such a construction, the leakage of high-frequency electromagnetic waves is effectively prevented because the electromagnetic waves are greatly attenuated by the shield.

In another mode of the second induction heater: the shield constitutes a heating chamber that can be closed; the coil is disposed outside of the heating chamber; the heating element is disposed inside of the heating chamber; and a microwave generator is provided for supplying microwaves into the heating chamber. In this induction heater, an object loaded in the heating chamber is heated by both the radiant heat emitted from the heating element and the microwaves supplied by the microwave generator. By such a construction, the leakage of microwaves out of the heating chamber is prevented without decreasing the efficiency of induction heating.

In still another mode of the second induction heater: the heating element is placed on a conveyor belt on a pair of rollers; a plurality of coils are disposed under the conveyor belt in series along the conveyor belt; and the conveyor belt constitutes the shield. An example of the conveyor belt is an elastic belt, made of rubber or the like, with a thin, metallic layer formed on the surface thereof.

In still another mode of the second induction heater: the coil is first covered with a first layer made of a synthetic resin; and the first layer is further covered with a thin, metallic layer constituting the shield. Such a construction is advantageous not only in that the leakage of undesired electromagnetic waves is prevented, but also in that a liquid (e.g. water or oil) is assuredly prevented from reaching the coil when the coil is used in the liquid, because pinholes of the first layer are sealed by the metallic layer.

BRIEF DESCRIPTION OF THE DRAWINGS

FIG. 5 shows the constitution of a cooking apparatus including a first embodiment of the second induction heater;

FIG. 6 is a table showing the shielding efficiency of a shielding box of the apparatus of FIG. 5;

FIG. 7 shows the constitution of another cooking apparatus including a second embodiment of the second induction heater;

DETAILED DESCRIPTION OF PREFERRED EMBODIMENTS

First, a cooking apparatus including an embodiment of the first induction heater is described below, referring to FIGS. 1 and 2. It should be noted that FIG. 2 is drawn upside down in order to more easily explain the induction heating unit of FIG. 1.

Figure 1:
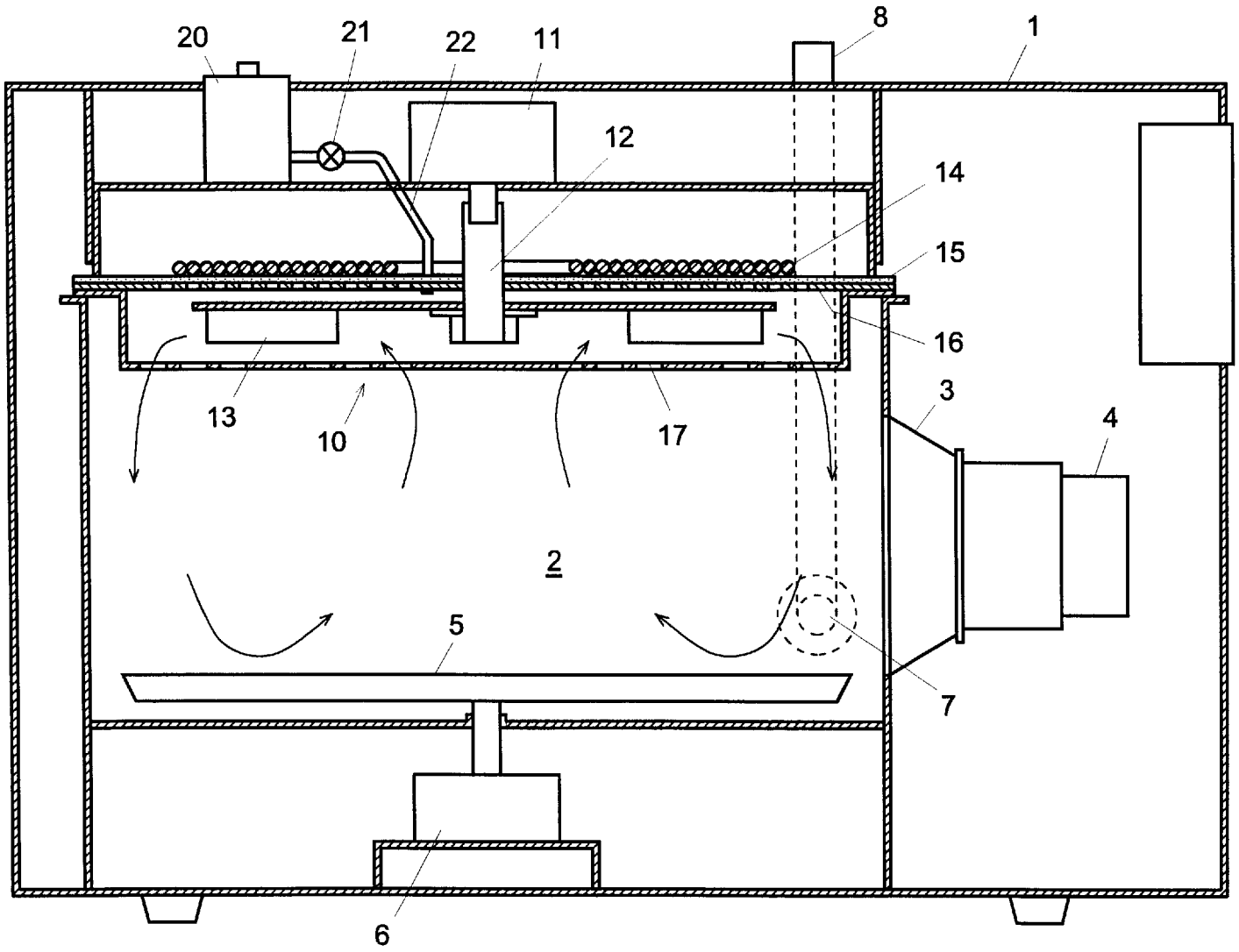
FIG. 1 is a sectional front view of a cooking apparatus including an embodiment of the first induction heater.
Figure 2:
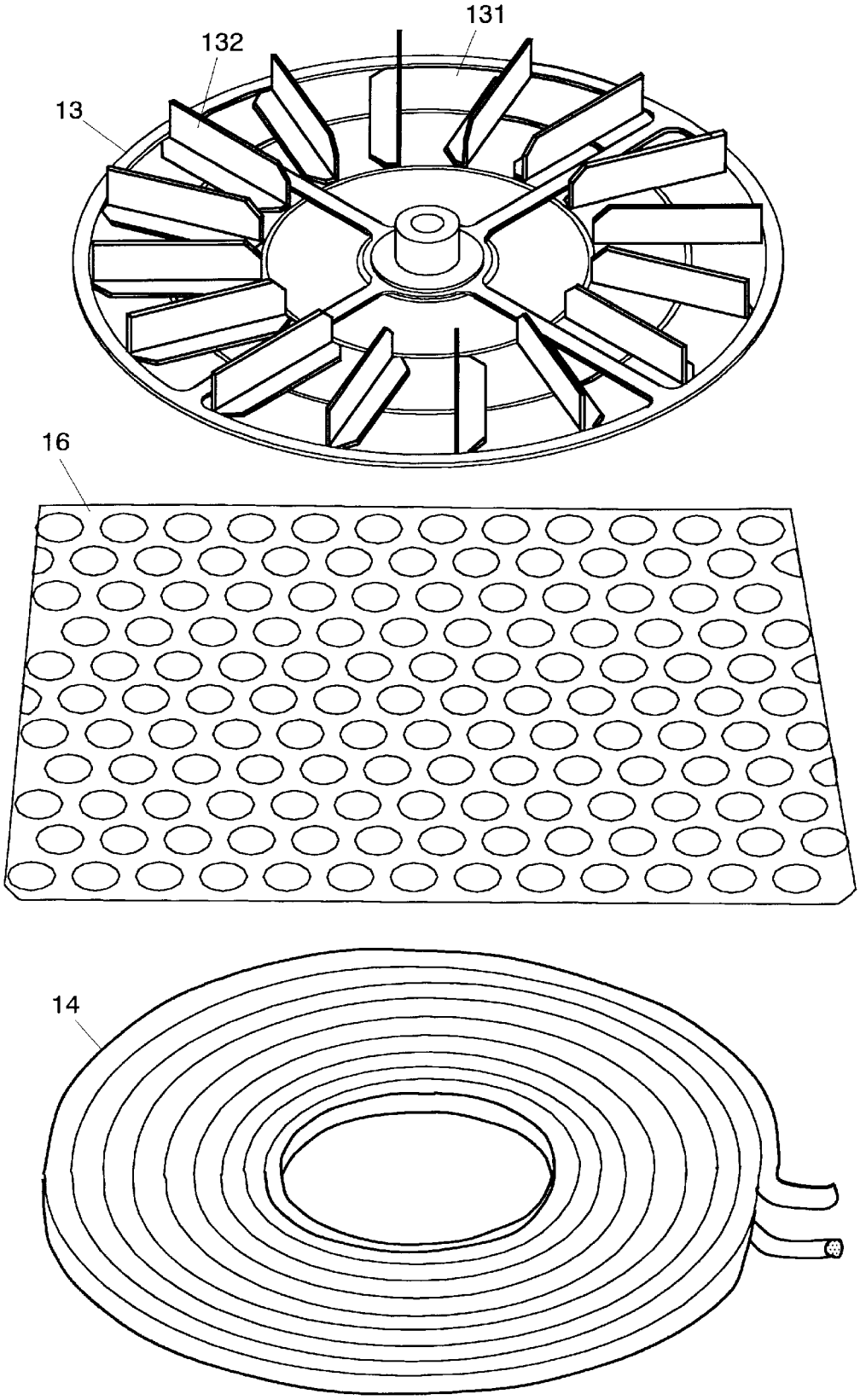
FIG. 2 is a perspective view of parts constituting an induction heating unit of the apparatus of FIG. 1.

Referring to FIG. 1, the cooking apparatus includes a casing 1 with a heating chamber 2 built therein. The heating chamber 2 has a front opening (not shown) and a door (not shown) for closing the front opening in an airtight manner. An induction heating unit 10 is provided at the top wall of the heating chamber 2. A magnetron 4 is attached to one side wall of the heating chamber 2 via a waveguide 3. A turntable 5 for mounting an object to be heated, such as food, is provided at the bottom of the heating chamber 2. The turntable 5 is driven by a motor 6 disposed under the heating chamber 2. An exhaust port 7 is provided in the lower part of the back wall of the heating chamber 2, and the lower end of an exhaust duct 8 is connected to the exhaust port 7. The upper end of the exhaust duct 8 protrudes from the top wall of the casing 1.

As described above, the cooking apparatus includes two types of heat sources, that is, the induction heating unit 10 and the magnetron 4, and the object placed on the turntable 5 is heated by energizing the two heat sources selectively or simultaneously.

Referring to FIG. 1, the induction heating unit 10 includes: a fan motor 11 disposed over the heating chamber 2; a fan 13 fixed to a rotation shaft 12 of the fan motor 11; a spiral coil 14 in the form of a flat disc centering on the rotation shaft 12; a supporting plate 15 made of ceramic and a shielding plate 16, both plates being disposed between the coil 14 and the fan 13; and a fan guard 17 attached to the top wall of the heating chamber 2 for covering the fan 13.

Referring to FIG. 2, the fan 13 consists of a disc 131 and a plurality of blades 132 fixed at preset angular intervals on one side (which is referred to as "front face" in this specification) of the disc. When the fan 13 is rotated in a proper direction, the fan 13 draws air from the center of its front face and propels the air to its circumference. Taking into account the fact that vaporized oil or other substances emitted from the heated object in the heating chamber 2 will stick to the surface of the fan 13, it is preferable to make the fan 13 from a non-magnetic metal having high corrosion resistance, such as stainless steel (ISO683-13 11).

The fan guard 17 consists of: a cylindrical wall part concentrically surrounding the fan 13 with a preset distance from the outer-most end of the fan 13; and a plate part disposed in front of the fan 13. The plate part is provided with air-drawing openings at the center and air-blowing openings at the periphery. The fan guard 17 is provided to prevent the fan 13 from being exposed in the heating chamber 2 and to allow a flow of air propelled by the blades 132 of the fan 13 to be evenly supplied through the air-blowing openings into the heating chamber 2.

The shielding plate 16 shields the coil 14 against microwaves supplied from the magnetron 4 into the heating chamber 2. Referring to FIG. 2, the shielding plate 16 consists of a metallic plate made of stainless steel (e.g. ISO683-13 11) or similar material, and has a plurality of holes. While shielding the coil 14 against the microwaves, the shielding plate 16 is required not to be a load for induction heating. That is, it is necessary that the shielding plate 16 allow the magnetic flux generated by the coil 14 to pass therethrough. Taking this into account, the thickness and the hole to plate area ratio of the shielding plate 16 are determined appropriately, as described later in the explanation of FIG. 3. For example, the shielding plate 16 is a metallic plate having holes at intervals of 1.7 mm, each hole being 1.4 mm in diameter. In this case, the hole to plate area ratio is about 61%. The supporting plate 15 is made of an insulating material and allow the magnetic flux generated by the coil 14 to pass therethrough. The functions of the supporting plate 15 are to support the shielding plate 16 and to cover the top of the heating chamber 2 in an airtight manner.

Above the heating chamber 2 is disposed a tank 20 with its top protruding from the top of the casing 1. A pipe 22 having a solenoid valve 21 extends from the tank 20, through the supporting plate 15 and the shielding plate 16, to a position behind the central part of the fan 13. When the solenoid valve 21 is opened, the water stored in the tank 20 is supplied through the pipe 22 onto the back face of the disc 131 of the fan 13. A fill opening is provided at the top of the tank 20 for replenishing water when the tank 20 is empty. Also, though not shown in FIG. 1, a drain port for draining water produced by the formation of dew in the heating chamber 2 is provided at the bottom of the heating chamber 2.

Regarding the operation of the apparatus described above, when high-frequency current is supplied from a high-frequency power source (not shown) to the coil 14, the coil 14 generates an alternating magnetic flux penetrating the fan 13, and the magnetic flux induces eddy currents in the fan 13. Here, the fan 13 itself is heated because Joule heat is generated by the eddy current. The heating power is controlled by changing the high-frequency current supplied to the coil 14.

When the fan 13 is rotated by the fan motor 11, the fan 13 draws air from the heating chamber 2 through the air-drawing opening. The air turns into hot air as a result of heat exchange with the fan 13, and is propelled outwards toward the circumference of the fan 13. The hot air is propelled out of the air-blowing openings into the heating chamber 2, so that a circulating flow of hot air is generated, as indicated by the arrows in FIG. 1. Due to the circulation of hot air, the temperature in the heating chamber 2 rises, whereby an object or food (not shown) placed on the turntable 5 is heated. When the hot air contacts the food, the surface of the food is modestly browned. The food is also heated by radiant heat generated by the fan 13, whose temperature becomes extremely high during the heating process.

Regarding the heating process, steam can be supplied into the heating chamber 2 by opening the solenoid valve 21 so that water flows through the pipe 22 at a desired flow rate. The water falls onto the back face of the disc 131 of the fan 13, rotating at a high speed, where the water is dispersed into tiny drops. The drops of water are vaporized into steam when they contact the fan 13 or hot air around the fan 13. The steam is carried into the heating chamber 2 by the flow of hot air. Supplying steam is preferable in that it prevents the food from drying, and it improves the heating efficiency, as the latent heat of the steam is transferred to the surface of the food.

Also, the food can be heated by energizing the magnetron 4 to generate microwaves. By this method, the food is directly cooked by heat generated inside itself. When such microwave heating is simultaneously carried out with the above-described hot air heating process, the cooking process of the food is completed in a shorter time without damaging its taste. Also, the surface of the food is browned to give it an appealing appearance.

A description of a preferable design of the shielding plate 16 follows. The main function of the shielding plate 16 is to prevent microwaves from leaking out of the heating chamber 2, as explained above. If the microwaves happen to reach the coil 14, they leak out of the heating chamber 2 through the terminal of the spiraling coil 14. It is of course possible to use a product for preventing the leakage at the terminal of the spiral. The use of such a product, however, generally makes the apparatus large and complicated, increasing the production cost. In the apparatus of the present embodiment, on the other hand, the microwaves are blocked by the most rational method, inserting the shielding plate 16 between the fan 13 and the coil 14. The shielding plate 16, however, must be designed so that it does not become an obstacle to the induction heating process of the fan 13.

Figure 3:
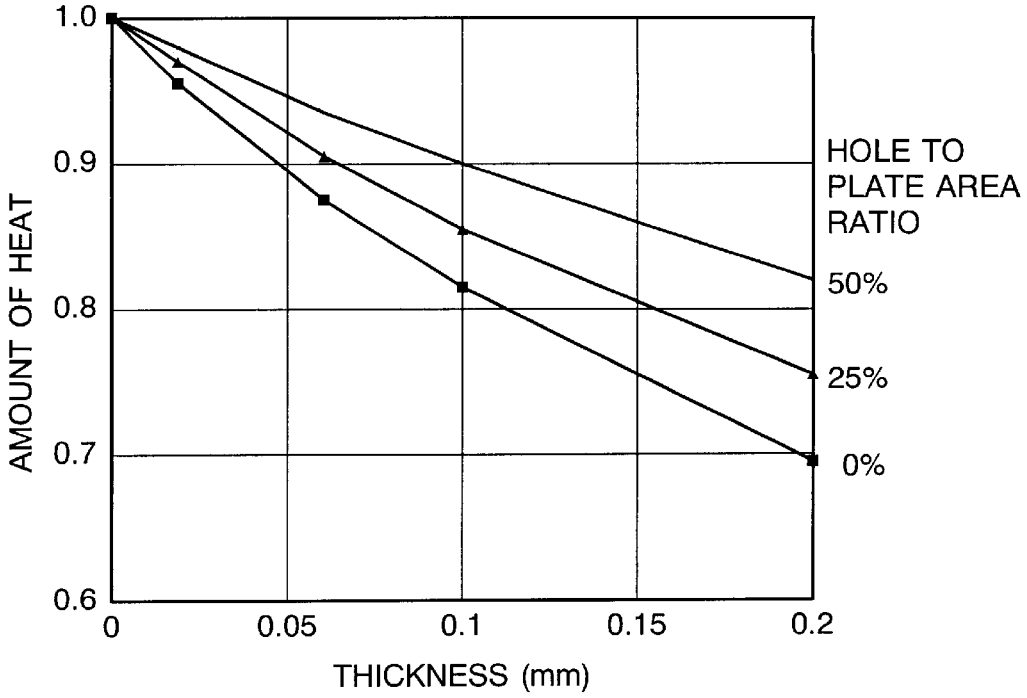
FIG. 3 is a graph showing the change of the amount of heat with respect to the hole to plate area ratio and thickness of a shielding plate.

Accordingly, a preferable design of the shielding plate 16 for effectively blocking microwaves while maintaining induction heating efficiency at an adequately high level, is considered as follows. For example, a microwave-shielding plate used in the window of the door of conventional microwave ovens has a 60 to 65% of hole to plate area ratio (determined by the hole diameter and the hole interval) and is about 0.4 mm in thickness. Taking account of these values, the decrease in the induction heating efficiency is calculated with the hole to plate area ratio and the thickness of the shielding plate as parameters. FIG. 3 is a graph showing the amount of heat remaining after passing through the shielding plate which changes depending on the hole to plate area ratio and the thickness of the shielding plate, where the amount of heat detected when there is no shielding plate (or the thickness of the shielding plate is 0 mm) is represented as 1.0. FIG. 3 shows that the amount of heat is smaller as the shielding plate becomes thicker, while the amount of heat is larger as the hole to plate area ratio becomes larger. Here, it should be noted that even when the shielding plate has no hole (i.e. the hole to plate area ratio is 0%), if the thickness of the plate is about 0.1 mm or smaller, the amount of heat exceeds 0.8, which is enough for practical use.

Figure 4:
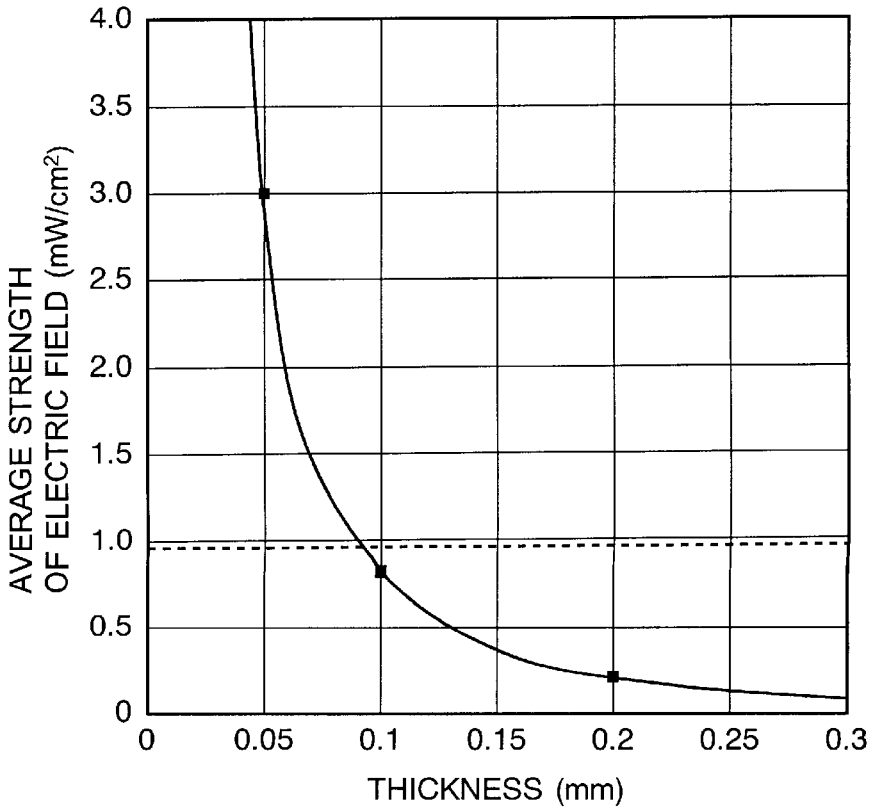
FIG. 4 is a graph showing the relation between the shielding efficiency against microwaves and the thickness of the shielding plate.

FIG. 4 is a graph showing the relation between the microwave-shielding efficiency and the thickness of the shielding plate, where the vertical axis corresponds to the average strength of the electric field of the microwaves after passing through the shielding plate, and the hole to plate area ratio is assumed to be 61%. Conventional microwave ovens are generally required to be designed so that the average strength of the electric field is under 1.0 $mW/cm^2$. FIG. 4 shows that the requirement is met when the thickness of the shielding plate is about 0.1 mm or larger. Referring to FIG. 3 again, the amount of heat is 0.9 when the thickness is 0.1 mm and the hole to plate area ratio is 50%. This means that the decrease in the amount of heat due to the shielding plate is less than 10% when the hole to plate area ratio is 61%. Thus, in the apparatus of the present embodiment, the shielding plate 16 is designed so that the hole to plate area ratio is 61%, as explained above. With such a shielding plate, not only are the microwaves blocked effectively, but also the induction efficiency is maintained at an adequately high level.

It should be noted that the apparatus of the above-described embodiment is a mere example and can be changed or modified variously within the spirit and scope of the invention. For example, each part used in the apparatus may be made of other material whose physical property is similar to that of the material described above. Also, it is assumed in the above-described apparatus that the induction heating unit 10 is provided at the top wall of the heating chamber 2. The unit 10, however, may be provided at a side wall or at the back wall.

Next, five embodiments of the second induction heater are described below.

[Embodiment 1]

FIG. 5 is a sectional front view of a cooking apparatus including a first embodiment of the second induction heater. The apparatus of Embodiment 1 includes a casing 36 made of insulating material such as synthetic resin or the like. A top plate 37 made of a heat-resistant resin, ceramic or other material, is removably set in the top of the casing 36. A pot or pan, which is referred to as a heating element 33, is placed on the top plate 36. The heating unit of the apparatus includes a spiral coil 31 in the form of a flat disc, a high-frequency power source 32 for supplying electric power to the coil 31, and the heating element 33. A power cord 38 is provided for supplying electric power from an external power source (not shown) to the high-frequency power source 32. A noise filter 34 is provided for removing high-frequency noise components from the voltage supplied from the power source. The coil 31 and the high-frequency power source 32 are enclosed in a shielding box 35. The shielding box 35 is made of metal such as stainless steel (ISO683-13 11), for example.

In the above-described apparatus, the high-frequency power source 32 is supplied with electric power through the power cord 38. During the heating process, a high-frequency current having a frequency of about several tens of kHz is supplied from the high-frequency power source 32 to the coil 31, whereby the coil 31 generates an alternating magnetic flux. The magnetic flux penetrates the shielding box 35, the top plate 37 and the heating element 33, whereby eddy currents are induced in the heating element 33, and the heating element 33 generates heat due to the eddy current loss. To supply electric power efficiently, the high-frequency power source 32 includes, for example, an inverter circuit which generates electromagnetic waves including higher harmonic components of the high-frequency current. Most of the electromagnetic waves are radiated from the coil 31 enclosed in the shielding box 35, resulting in almost no electromagnetic leakage.

An explanation of the shielding efficiency of the shielding box 35 follows, referring to FIG. 6. FIG. 6 is a table showing the relation between the thickness of the plate forming the shielding box 35 and the efficiency of blocking the high-frequency electromagnetic waves. FIG. 6 shows, for example, that when the frequency component is at 25 kHz, the most suitable frequency for induction heating, 82% of the component passes through the plate whose thickness is 0.1 mm. In other words, when the 25 kHz frequency component hits the plate of 0.1 mm in thickness, the decrease in the strength of the component is only 18%. Electromagnetic waves having 150 MHz of frequency, on the other hand, are blocked almost completely. Accordingly, by using the above-described plate constituting the shielding box 35, the higher harmonic component is blocked effectively without decreasing the induction heating efficiency.

[Embodiment 2]

FIG. 7 shows the constitution of another cooking apparatus including a second embodiment of the second induction heater. The apparatus of Embodiment 2 is designed for heating a plurality of foods at one time and is suitable for commercial use.

The apparatus of Embodiment 2 includes a pair of rollers 40, 41 provided parallel to each other and an endless belt 42 on the rollers. A plurality of heating elements 33 (pans or pots) are placed in a row on the upper stretch of the belt 42, and a plurality of coils 31 are disposed under the upper stretch of the belt 42. Each coil 31 is supplied with high-frequency electric power by a high-frequency power source 32.

The roller 40 is driven by a motor (not shown) rotating at a preset speed, whereby the belt 42 moves at a preset speed, and the other roller 41 follows the movement in turn. As the belt 42 moves, the heating elements 33 placed on the belt 42 are conveyed along the belt 42, and each is inductively heated as it passes through the respective magnetic fields generated by the coils 31, one after another. Thus, the heating element 33 is heated almost constantly while being conveyed by the belt 42.

The belt 42 is constituted to function as a shielding plate. For example, a rubber belt covered with a thin metal layer formed by the vacuum evaporation method can be used as the belt 42. When contaminants such as oil or fragments of food are ejected from an object in the heating element 33 and stick to the outer surface of the belt 42, the contaminants are scraped off the belt 42 by a scraper 43 while the belt 42 is moving.

Next, another cooking apparatus including a third embodiment of the second induction heater is described below as Embodiment 3. The apparatus of Embodiment 3 is constituted so that an object can be heated not only by the induction heating method but also by the microwave heating method used in microwave ovens.

[Embodiment 3]

Figure 8:
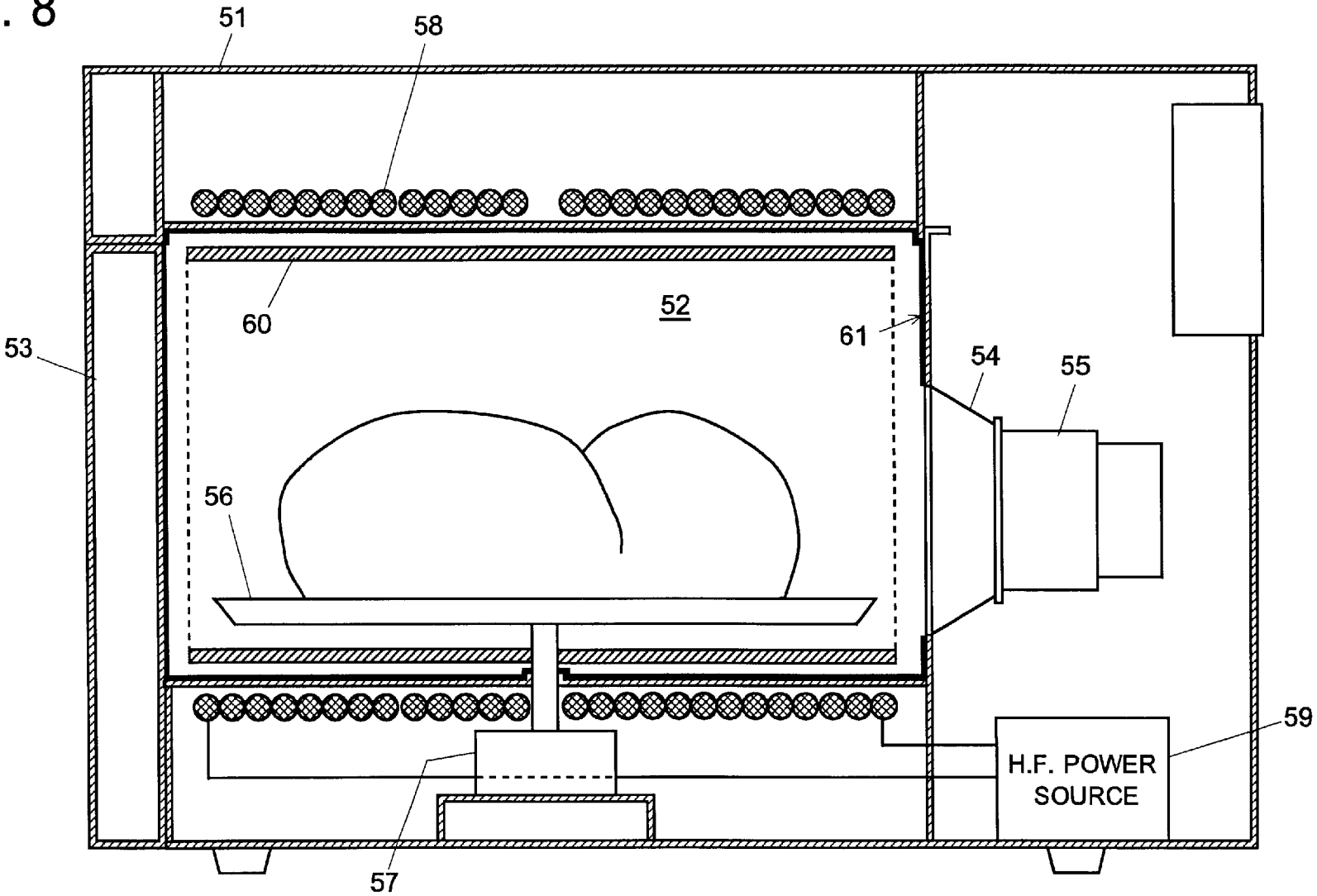
FIG. 8 shows the constitution of another cooking apparatus including a third embodiment of the second induction heater.

FIG. 8 is a sectional side view of the cooking apparatus of Embodiment 3. The apparatus includes a casing 51 with a box-like heating chamber 52 built therein. The heating chamber 52 is made of an insulating material such as ceramic or heat-resistant resin. The heating chamber 52 has a front opening which can be closed by a door 53. A magnetron 55 is attached to the back wall of the heating chamber 52 via a waveguide 54. A turntable 56 for mounting an object to be heated, such as food, is provided at the bottom of the heating chamber 52. The turntable 56 is driven by a motor 57.

A coil 58 spirals around the outer surface of the heating chamber 52 across the four walls, except for the front and back walls of the heating chamber 52. The coil 58 is supplied with high-frequency electric power by a high-frequency power source 59 disposed behind the heating chamber 52. A heating element 60 in the form of a box with its front and back sides open is disposed in the heating chamber 52 at a preset distance from the walls of the heating chamber 52.

The inner surface of the heating chamber 52 and the inner surface of the door 53 are covered with shielding plates 61, except for the area where the waveguide 54 is attached. The metallic plate described in Embodiment 1 can also be used as the shielding plate 61. The main function of the shielding plates 61 is to prevent the leakage of the microwaves being supplied into the heating chamber 52 from the magnetron 55 while allowing the magnetic flux generated by the coil 58 to pass therethrough.

Regarding the above-described apparatus, when high-frequency current is supplied from the high-frequency power source 59 to the coil 58, the coil 58 generates an alternating magnetic flux penetrating the shielding plate 61 and the heating element 60. Thus, the heating element 60 generates heat, and the object placed on the turntable 56 is heated by the radiant heat from the heating element 60. Also, the object can be heated with microwaves by energizing the magnetron 55 so that microwaves are supplied into the heating chamber 52 through the waveguide 54. By using the two heating methods simultaneously, the process of heating the object is completed in a short time. The surface of the object is browned by the heat from the heating element 60.

In the above description, it is assumed that the shielding plate 61 is a metallic plate having no holes. However, a metallic plate having a number of small holes punched therein may be used as the shielding plate 61. As for the thickness of the plate, even a metallic plate that is slightly thicker may be used as the shielding plate 61 if the resistance of the metal is sufficient because metal that has much resistance hardly acts as a load for induction heating.

[Embodiment 4]

Figure 9:
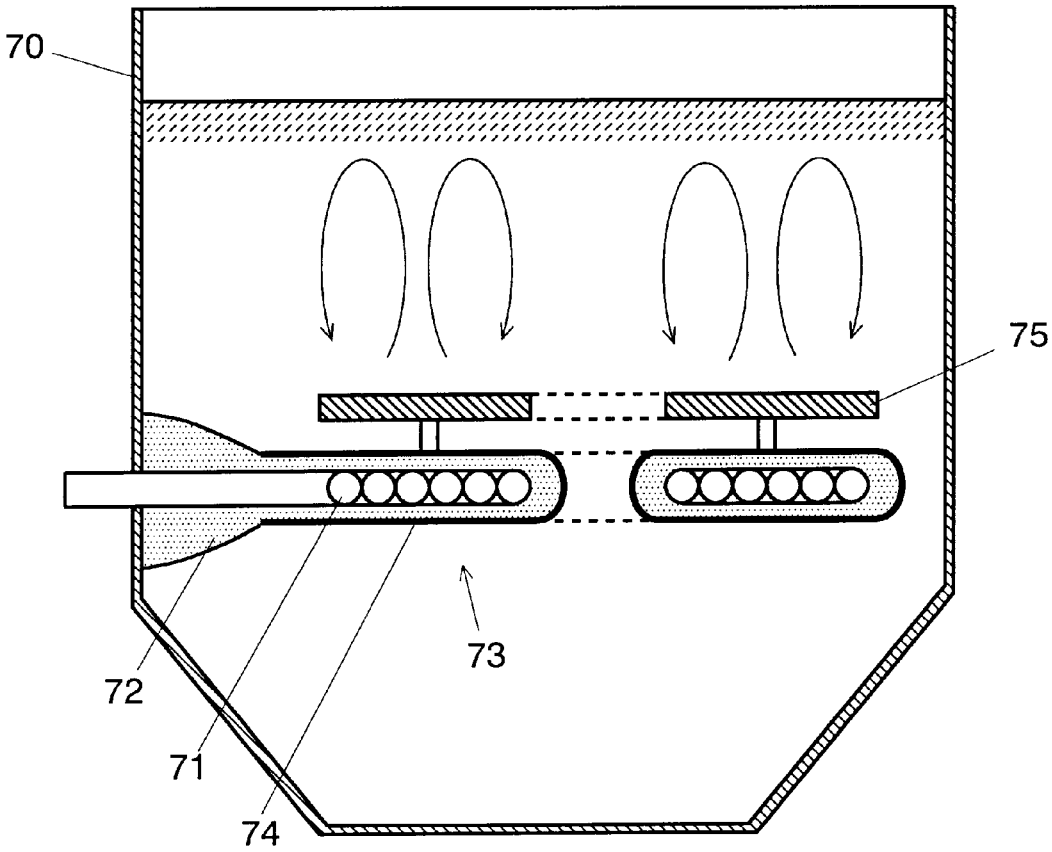
FIG. 9 shows the constitution of another cooking apparatus including a fourth embodiment of the second induction heater.

FIG. 9 shows the constitution of another cooking apparatus including a fourth embodiment of the second induction heater. The cooking apparatus of Embodiment 4 is designed for the fry-cooking of food using edible oil.

The apparatus of Embodiment 4 includes a pot 70 for retaining oil and a coil holder 73 made of a heat-resistant synthetic resin molded into a protection layer 72 for protecting and supporting a spiral coil 71, which is fixedly provided in the pot 70. A thin metallic layer 74 is formed on the surface of the protection layer 72 by the non-electroplating method or by other methods. A heating element 75 is mounted on the top of the coil holder 73. The heating element 75 is shaped into a flat ring so that it has a large surface area.

Regarding the above-described apparatus, an adequate amount of oil is retained in the pot 70 so that the heating element 75 is submerged, and high-frequency electric power is supplied from a high-frequency power source (not shown) to the coil 71. The coil 71 generates an alternating magnetic flux penetrating the heating element 75, which generates heat due to the eddy current loss. The temperature of the oil rises as a result of heat exchange with the heating element 75, and food dipped in the oil will be fry-cooked. Thus, the fry-cooking of food dipped in the oil proceeds.

In the process of molding the synthetic resin into the protection layer, it is probable that pinholes will be formed in the protection layer. The pinholes, however, are assuredly sealed by the metallic layer 74 formed on the surface of the protection layer 72, protecting the coil 71 assuredly against the oil or other liquid. Thus, the oil is prevented from reaching the coil 71 and, accordingly, corrosion of the coil 71 is avoided effectively.

[Embodiment 5]

Figure 10:
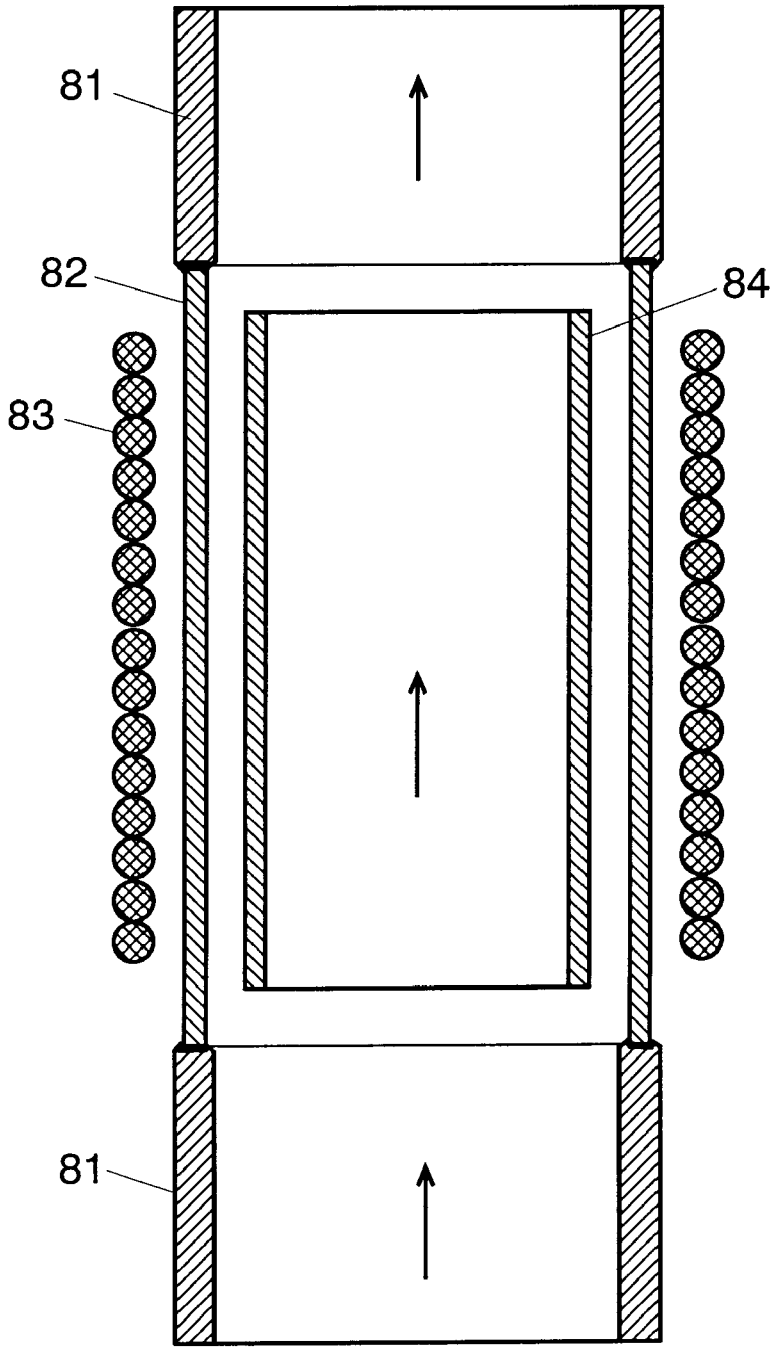
FIG. 10 shows the constitution of a liquid-heating apparatus including a fifth embodiment of the second induction heater; and, FIG. 11 shows the constitution of a conventional cooking apparatus.
Figure 11:
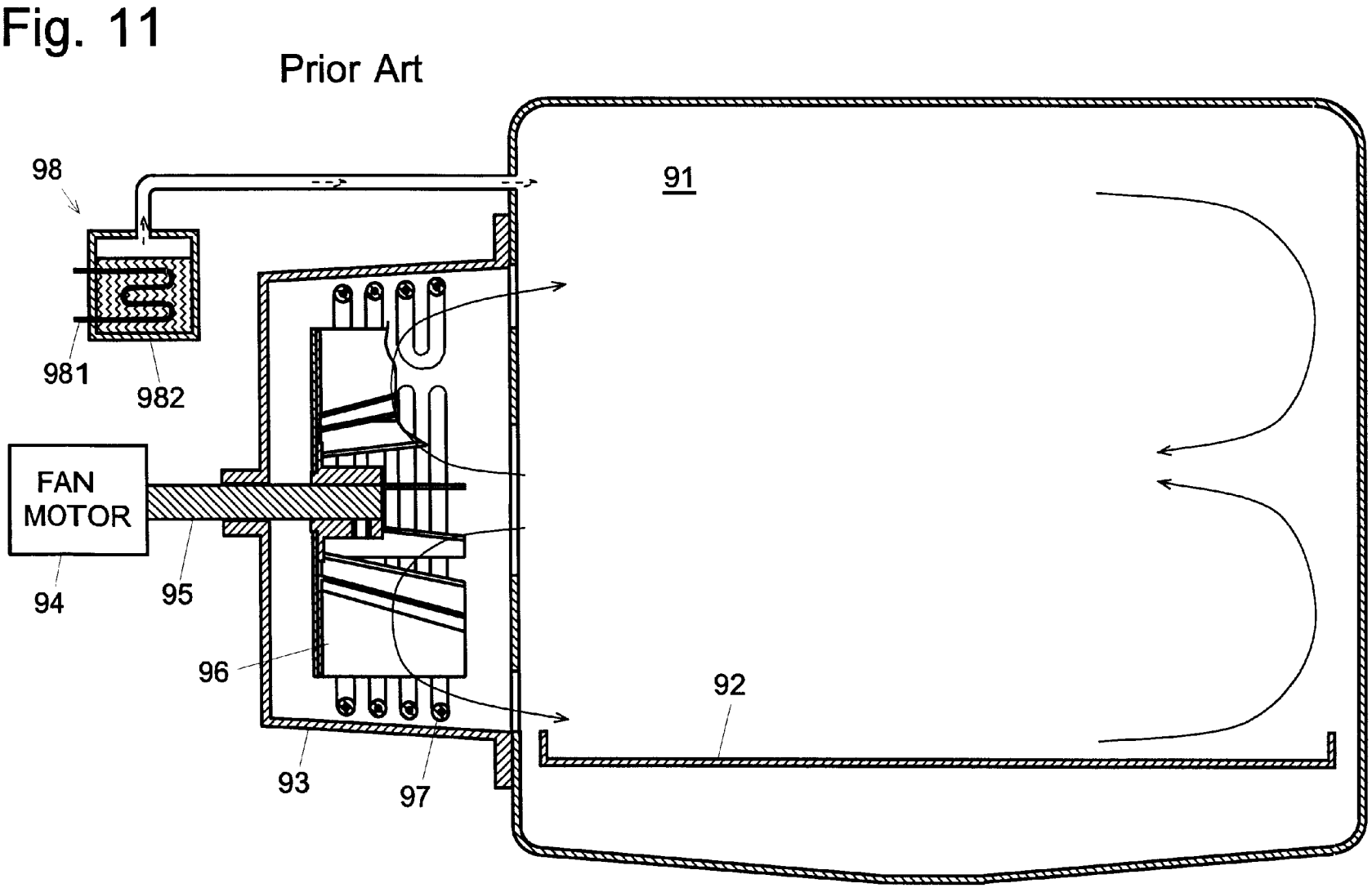
Fig. 11 Prior Art

FIG. 10 shows the constitution of a liquid-heating apparatus including a fifth embodiment of the second induction heater. The apparatus has a metallic pipe 81 used as a passage for liquid, such as water, and having a connection part 82 welded to the upstream part and the downstream part of the metallic pipe 81. The connection part 82 is a cylindrical metallic body whose wall is thinner than that of the pipe 81. A coil 83 is wound around the connection part 82, and a cylindrical heating element 84 is inserted into the connection part 82. In this apparatus, when high-frequency electric power is supplied from a high-frequency power source (not shown) to the coil 83, the coil 83 generates an alternating magnetic flux. The magnetic flux penetrates the connection part 82 and the heating element 84, whereby the heating element 84 generates heat due to the eddy current loss. Thus, the temperature of the liquid flowing in the pipe 81 rises as a result of heat exchange with the heating element 84.

Regarding conventional liquid-heating apparatuses, the connection part cannot be connected to the metallic pipe by welding, because the connection part of conventional apparatuses is made of an insulating material, such as ceramic. Hence, it is necessary to use a more costly method for connecting the connection part to the metallic pipe. Regarding a liquid-heating apparatus including a type of the second induction heater, on the other hand, a metallic cylindrical member can be used as the connection part, so that the connection part can be connected to the metallic pipe as shown in Embodiment 5, by welding. Thus, the manufacture of the liquid-heating apparatus is facilitated and the production cost is reduced.

What is claimed is:

1. An induction heater that inductively heats an object, comprising:

a coil;

a power supply unit that supplies high-frequency electric power to the coil, whereby the coil inductively heats a heating element; and a shield disposed between the heating element and the coil, wherein the shield allows a substantial amount of magnetic flux generated by the coil to pass through the shield, and wherein the shield encloses the coil and the power supply unit, except for a power cord for supplying electric current.

2. An induction heater that inductively heats an object, comprising:

a plurality of coils disposed in a line;

a power supply unit that supplies high-frequency electric power to the plurality of coils; and a conveyor belt on a pair of rollers, the conveyor belt including a metal layer and forming a shield between the plurality of coils and a heating element placed on the conveyor belt, the shield allowing a substantial amount of magnetic flux generated by the plurality of coils to pass through the shield.

3. An induction heater that inductively heats an object, comprising:

a coil covered with a synthetic resin layer;

a metallic layer covering the synthetic resin layer; and a power supply unit that supplies high-frequency electric power to the coil, whereby the coil inductively heats a heating element;

wherein the metallic layer forms a shield between the heating element and the coil and allows a substantial amount of magnetic flux generated by the coil to pass through the shield.

4. A cooking apparatus, comprising:

a heating chamber;

a heating element disposed inside of the heating chamber;

a coil that generates magnetic flux which inductively heats the heating element; and a microwave generator that supplies microwaves in to the heating chamber; wherein a wall of the heating chamber blocks the microwaves while allowing a substantial amount of the magnetic flux to pass through the wall;

the coil is disposed outside of the heating chamber and is shielded from the microwaves by the wall; and the heating element radiantly heats an object to be cooked.

5. The cooking apparatus according to claim 4, wherein:

the heating element is a metallic fan, provided at an inner wall of the heating chamber, that draws air from a center of the heating chamber and propels the air toward a circumference of the heating chamber; and the coil is provided behind the metallic fan.

6. The cooking apparatus according to claim 5, wherein the coil is a spiral coil in a form of a flat disc centering on a rotation shaft of the fan.

7. The cooking apparatus according to claim 5, wherein the shield is a metallic plate provided with a number of holes at a preset hole-to-plate area ratio.

8. The cooking apparatus according to claim 5, wherein the shield is a thin, metallic plate having no holes.

9. The cooking apparatus according to claim 5, further comprising a fan guard including:

a cylindrical wall part concentrically surrounding the fan at a preset distance from an outer-most end of the fan; and a plate part disposed in front of the fan and having an air-drawing opening and an air-blowing opening.

10. The cooking apparatus according to claim 5, wherein the fan is provided at a top wall of the heating chamber with its front face directed downwards.

11. The cooking apparatus according to claim 10, further comprising a water supply unit that supplies water onto a back of the fan.

12. The cooking apparatus according to claim 5, wherein the shield is made of metal.

13. The cooking apparatus according to claim 4, wherein the heating element is spaced from the wall of the heating chamber.

14. A fluid heating apparatus, comprising:

a fluid passage defined by a metallic pipe;

a heating element disposed in the fluid passage;

a coil disposed outside the metallic pipe; and a power supply unit that supplies high-frequency electric power to the coil, whereby the coil inductively heats the heating elements, wherein the heating element and the coil are located at a first portion of the metallic pipe that has a wall that is thinner than a wall of a second portion of the metallic pipe.

15. The fluid heating apparatus of claim 14, wherein the first portion of the metallic pipe is welded to the second portion of the metallic pipe.

* * * * *